US012630775B2

(12) United States Patent
Dimick

(10) Patent No.: US 12,630,775 B2
(45) Date of Patent: May 19, 2026

(54) FUEL ADDITIVE COMPOSITION AND RELATED METHODS

(71) Applicant: Innovativ Industries LLC, Lehi, UT (US)

(72) Inventor: Tanner J. Dimick, Lehi, UT (US)

(73) Assignee: INNOVATIV INDUSTRIES LLC, Lehi, UT (US)

( * ) Notice: Subject to any disclaimer, the term of this patent is extended or adjusted under 35 U.S.C. 154(b) by 8 days.

(21) Appl. No.: 18/444,326

(22) Filed: Feb. 16, 2024

(65) Prior Publication Data

US 2025/0263613 A1 Aug. 21, 2025

(51) Int. Cl.

| | |
|---|---|
| ***C10L 1/14*** | (2006.01) |
| ***C10L 10/02*** | (2006.01) |
| ***C10L 10/08*** | (2006.01) |
| ***C10L 10/10*** | (2006.01) |
| *C10L 1/16* | (2006.01) |

(Continued)

(52) U.S. Cl.

CPC ..... *C10L 1/143* (2013.01); *C10L 10/02* (2013.01); *C10L 10/08* (2013.01); *C10L 10/10* (2013.01); *C10L 1/1608* (2013.01); *C10L 1/1616* (2013.01); *C10L 1/1641* (2013.01); *C10L 1/1826* (2013.01); *C10L 1/1915* (2013.01); *C10L 2230/22* (2013.01)

(58) Field of Classification Search

CPC ..... C10L 1/143; C10L 1/608; C10L 1/1616; C10L 1/1826; C10L 1/1915; C10L 10/02; C10L 10/08; C10L 10/10; C10L 2230/22

See application file for complete search history.

(56) References Cited

U.S. PATENT DOCUMENTS

| | | | | |
|---|---|---|---|---|
| 4,375,973 A * | 3/1983 | Rossi | C10L 1/143 44/459 |
| 5,087,268 A * | 2/1992 | Parish | C10L 10/02 44/367 |
| 6,102,975 A | 8/2000 | Marr | |

(Continued)

FOREIGN PATENT DOCUMENTS

| | | |
|---|---|---|
| CN | 102676246 B | 7/2014 |
| CN | 108998122 A | 12/2018 |

(Continued)

OTHER PUBLICATIONS

Liang Ding, Alison M Cupples; "The effect of the potential fuel additive isobutanol on benzene, toluene, ethylbenzene, and p-xylene degradation in aerobic soil microcosms"; Environ Technology; Jan.-Feb. 2015; 36(1-4); 237-44; DOI: 10.1080/09593330.2014.943298. Epub Aug. 5, 2014; abstract.

(Continued)

*Primary Examiner* — Vishal V Vasisth

(74) *Attorney, Agent, or Firm* — MASCHOFF BRENNAN

(57) ABSTRACT

The invention relates to a fuel additive composition and a method of enhancing the properties of fuel. The composition includes a hydrophilic absorbent, a lubricant, an octane adjuster, an trialkyl benzene, a dispersant, a polycyclic aromatic hydrocarbon, a fatty acid methyl ester, petroleum distillates, a mineral oil, and an elastomeric polymer. The method involves adding the fuel additive composition to the fuel, where each component performs a specific function to improve the fuel's properties.

20 Claims, 1 Drawing Sheet

(51) Int. Cl.
*C10L 1/182* (2006.01)
*C10L 1/19* (2006.01)

(56) References Cited

U.S. PATENT DOCUMENTS

| | | | |
|---|---|---|---|
| 6,592,639 | B2 | 7/2003 | Bernasconi et al. |
| 7,648,539 | B2 | 1/2010 | Wetzel |
| 7,927,387 | B1 | 4/2011 | DiFilippo |
| 8,551,365 | B2 | 10/2013 | Posselt et al. |
| 9,267,465 | B2 | 2/2016 | Monsallie et al. |
| 10,344,235 | B2 | 7/2019 | Bradin et al. |
| 10,407,633 | B2 | 9/2019 | Volpert et al. |
| 11,124,720 | B2 | 9/2021 | Bartley et al. |
| 2009/0013591 | A1 | 1/2009 | Bradin et al. |
| 2010/0293841 | A1 | 11/2010 | Zuckerman |
| 2018/0298295 | A1 | 10/2018 | Volpert et al. |

FOREIGN PATENT DOCUMENTS

| | | | |
|---|---|---|---|
| EP | 1904610 | A1 | 4/2008 |
| KR | 2013-0125880 | A | 11/2013 |
| KR | 10-2111623 | B1 | 5/2020 |
| KR | 102503500 | B1 | 2/2023 |
| WO | 2000017292 | A1 | 3/2000 |
| WO | 2009/051462 | A1 | 4/2009 |

OTHER PUBLICATIONS

Chevron Oronite Company LLC; Specialty Chemicals—Polyisobutylene (PIB)-Based Fuel Additives; Website; 2022-2024; located at: https://www.oronite.com/products-technology/specialty-chemicals.html; accessed on Feb. 16, 2024.

* cited by examiner

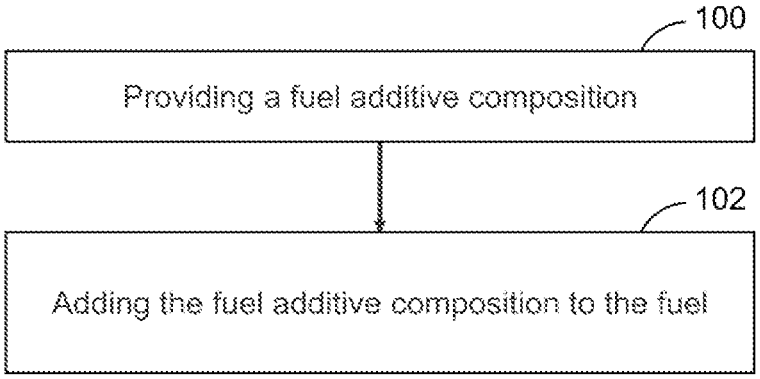
100
Providing a fuel additive composition
102
Adding the fuel additive composition to the fuel

FUEL ADDITIVE COMPOSITION AND RELATED METHODS

BACKGROUND

Field

The invention pertains to the field of fuel additives, specifically those that include a hydrophilic absorbent, lubricant, octane adjuster, trialkyl benzene, dispersant, polycyclic aromatic hydrocarbon (PAH), fatty acid methyl ester (FAME), petroleum distillates, mineral seal oil, and elastomeric polymer.

Description of Related Art

Fuel additives are chemical compounds introduced into fuel to enhance its performance and address specific needs, including the pursuit of improved fuel economy. These additives serve various purposes, such as increasing combustion efficiency, reducing friction, preventing deposits, and improving overall engine cleanliness. The demand for improved fuel economy has grown significantly in response to environmental concerns and the desire to reduce greenhouse gas emissions. Fuel additives play a crucial role in achieving this goal by optimizing combustion processes, minimizing engine wear, and ensuring smoother operation. Additives like friction modifiers, detergents, and octane boosters contribute to enhanced fuel efficiency, reduced emissions, and prolonged engine life. As automotive technologies advance, the development and utilization of effective fuel additives continue to be essential in meeting the demands for greater fuel economy and sustainability in the transportation sector.

The imperative to improve fuel economy and reduce emissions stems from a combination of environmental, economic, and sustainability concerns. With the ever-increasing global demand for energy and the rise in vehicular populations, there is a pressing need to curtail the environmental impact of transportation. Improved fuel economy not only translates into reduced fuel consumption, lowering costs for consumers, but also lessens the carbon footprint associated with the burning of fossil fuels. The transportation sector is a significant contributor to air pollution and greenhouse gas emissions, which are linked to climate change and adverse health effects. Governments, industry leaders, and consumers alike recognize the urgency of transitioning towards cleaner and more efficient modes of transportation. Advancements in engine technologies, the development of hybrid and electric vehicles, and the utilization of alternative fuels are among the strategies employed to address these challenges. As societies strive for sustainable and eco-friendly solutions, the quest for improved fuel economy and reduced emissions remains paramount in shaping the future of transportation.

Thus, there is a need for a fuel additive composition that can increase fuel efficiency and reduce emissions.

SUMMARY

In some embodiments, a fuel additive composition can include: a hydrophilic absorbent component; a lubricant; an octane adjuster; an emissions reducer; a dispersant; a polycyclic aromatic hydrocarbon; at least one fatty acid methyl ester; a petroleum distillate; a mineral oil; and an elastomeric polymer. In some aspects: the hydrophilic absorbent component includes an alkyl glycol; the lubricant includes an alkyl benzene; the octane adjuster includes a xylene or alkyl xylene; the emissions reducer includes an trialkyl benzene; the dispersant includes a branched alkyl alcohol; the at least one fatty acid methyl ester includes C12 to C24 alkyl chains; the mineral oil is mineral seal oil. In some aspects, the alkyl glycol includes ethylene glycol or propylene glycol; the alkyl benzene includes a C1-C6 alkyl group; the xylene or alkyl xylene includes dialkyl benzenes, wherein the alkyl group is selected from methyl, ethyl, propyl, butyl, pentyl, hexyl, heptyl, octyl, nonyl, and combinations thereof; the trialkyl benzene includes at three alkyl groups selected from methyl, ethyl, propyl, butyl, pentyl, hexyl, heptyl, octyl, nonyl, and combinations thereof; the branched alkyl alcohol includes an alkyl trunk and at least one alkyl branch, the alkyl trunk is selected from methyl, ethyl, propyl, butyl, pentyl, hexyl, heptyl, octyl, and nonyl, and the at least one alkyl branch is selected from methyl, ethyl, propyl, butyl, pentyl, hexyl, heptyl, octyl, and nonyl; the at least one fatty acid methyl ester includes C12 to C24 alkyl chains; the mineral oil is mineral seal oil; the polycyclic aromatic hydrocarbon. In some aspects: the hydrophilic absorbent component is ethylene glycol; the lubricant is ethylbenzene; the octane adjuster includes xylenes; the emissions reducer includes 1,2,4,-trimethylbenzene; the dispersant includes 2-ethylhexanol; the polycyclic aromatic hydrocarbon includes naphthalene; the least one fatty acid methyl ester includes a C16 alkyl chain fatty acid methyl ester and a C18 alkyl chain fatty acid methyl ester; the petroleum distillate; the mineral oil is mineral seal oil; and the elastomeric polymer is polyisobutene. In some aspects: the hydrophilic absorbent component is present at about 0.4 to about 0.7 wt %; the lubricant is present at about 0.5 to about 0.85 wt %; the octane adjuster is present at about 4.5 to about 6.25 wt %; the emissions reducer is present at about 0.15 to about 0.5 wt %; the dispersant is present at about 5.8 to about 6.8 wt %; the polycyclic aromatic hydrocarbon is present at about 0.15 to about 0.25 wt %; the least one fatty acid methyl ester is present at about 0.3 to about 0.8 wt %; the petroleum distillate is present at about 20 to about 90 wt %; the mineral oil is present at about 5 to about 30 wt %; and the elastomeric polymer is present at about 1 to about 60 wt % (e.g., wide range where solvation is used for getting polymer into solution).

In some embodiments, the amount of elastomeric polymer (e.g., polyisobutylene, polyisobutene) can be greatly varied to produce different products so long as the elastomeric polymer is in solution. The process of solvation can be used to get the elastomeric polymer into solution. The dissolving process can be divided into two stages: First, the solvent molecule swells and gels the polymer through diffusion into polymer lattices, and then the gel disperses into the solvent, resulting in a solution. This allows for the variations in amount of the elastomeric polymer. The elastomeric polymer can be present from about 1 to about 60 wt %, about 1.25 to about 50 wt %, about 1.5 to about 40 wt %, about 1.75 to about 30 wt %, about 2 to about 25 wt %, about 2.25 to about 15 wt %, or about 2.5 to about 10 wt %. Ranges between 1-10 wt %, 1-8 wt %, 1-6 wt %, 1-5 wt %, 1-4 wt %, and 1-3 wt % can also be used for the elastomeric polymer.

In some embodiments, the fuel additive includes: the ethylene glycol component is present at about 0.4 to about 0.7 wt %; the ethylbenzene is present at about 0.5 to about 0.85 wt %; the xylenes are present at about 4.5 to about 6.25 wt %; the 1,2,4,-trimethylbenzene is present at about 0.15 to about 0.5 wt %; the 2-ethylhexanol is present at about 5.8 to about 6.8 wt %; the naphthalene is present at about 0.15 to about 0.25 wt %; C16 alkyl chain fatty acid methyl ester and a C18 alkyl chain fatty acid methyl ester are present at about 0.3 to about 0.8 wt %; the petroleum distillate is present at about 20 to about 90 wt %; the mineral seal oil is present at about 5 to about 30 wt %; and the polyisobutene is present at about 1 to about 60 wt %.

In some embodiments, the fuel additive composition includes: the ethylene glycol component is present at about 0.54 wt %; the ethylbenzene is present at about 0.67 wt %; the xylenes are present at about 5.11 wt %; the 1,2,4,-trimethylbenzene is present at about 0.31 wt %; the 2-ethylhexanol is present at about 6.27 wt %; the naphthalene is present at about 0.6 wt %; C16 alkyl chain fatty acid methyl ester and a C18 alkyl chain fatty acid methyl ester are present at about 0.54 wt % (e.g., C16 FAME 0.12 wt % and C18 FAME 0.42 wt %); the petroleum distillate is present at about 72.63 wt %; the mineral seal oil is present at about 12.55 wt %; and the polyisobutene is present at about 1.32 wt %, wherein each wt % is +/−10%.

In some embodiments, a method of treating fuel can include: providing the fuel additive of one of the embodiments; providing a fuel for an engine; and introducing the fuel additive to the fuel. The engine can be an internal combustion engine or a diesel engine. The method can include introducing 1 oz of fuel additive to 10 gallons of fuel.

In some embodiments, a method of improving fuel economy in a vehicle can include: providing the fuel additive of one of the embodiments; providing a vehicle having a fuel tank; introducing the fuel additive into fuel in the fuel tank of the vehicle; operating the vehicle by combusting the fuel in an engine, wherein fuel economy is improved with fuel having the fuel additive compared to the fuel without the fuel additive. In some aspects, the improvement in fuel economy is at least 4%, or optionally about 4% to about 50%, or about 10% to about 25%, or about 11% to about 20%, or about 12% to about 15%. The engine can be an internal combustion engine or a diesel engine. The method can include introducing 1 oz of fuel additive to 10 gallons of fuel, or about 0.5 to about 2 ounces of fuel additive to about 10 gallons of fuel, or about 0.75 to about 1.5, or about 0.8 to about 1.25 ounces of fuel additive per 10 gallons of fuel.

In some embodiments, a method of reducing emissions in a vehicle can include: providing the fuel additive of one of the embodiments; providing a vehicle having a fuel tank; introducing the fuel additive into fuel in the fuel tank of the vehicle; operating the vehicle by combusting the fuel in an engine, wherein emissions from the vehicle are reduced with fuel having the fuel additive compared to the fuel without the fuel additive. In some aspects, the improvement in emissions is: hydrocarbons reduced by up to about 78%; $NO_x$ reduced by up to about 5%; NO reduced by up to about 5%; $NO_2$ reduced by up to about 3%; CO reduced by up to about 3%; and $CO_2$ reduced by up to about 3%. The method can include introducing 1 oz of fuel additive to 10 gallons of fuel, or about 0.5 to about 2 ounces of fuel additive to about 10 gallons of fuel, or about 0.75 to about 1.5, or about 0.8 to about 1.25 ounces of fuel additive per 10 gallons of fuel.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

FIG. 1 illustrates, in a flowchart, operations for enhancing the properties of fuel with a specific additive composition in accordance with certain embodiments.

The elements and components in the FIGURES can be arranged in accordance with at least one of the embodiments described herein, and which arrangement may be modified in accordance with the disclosure provided herein by one of ordinary skill in the art.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the FIGURES, can be arranged, substituted, combined, separated, and designed in a wide variety of different configurations, all of which are explicitly contemplated herein.

Generally, the present technology includes compounds and/or materials for use as a fuel additive. Fuel additives are substances that are added to fuel to improve its properties and performance. They are used in various types of fuels, including gasoline, diesel, and biofuels. Fuel additives can serve a variety of functions, such as improving fuel economy, enhancing power and acceleration, reducing emissions, and preventing engine damage. They can also help to maintain fuel stability and prevent fuel system corrosion. Some fuel additives can absorb water, which can help to prevent fuel system corrosion and improve combustion. Other fuel additives can serve as lubricants, which can help to reduce friction and wear in the fuel system. Some fuel additives can adjust the octane of the fuel, which can help to prevent engine knocking and improve engine performance. Some fuel additives can reduce emissions, which can help to protect the environment. Some fuel additives can serve as dispersants, which can help to improve the properties of the fuel. Some fuel additives can include polycyclic aromatic hydrocarbons (PAHs), which can help to improve combustion performance. Some fuel additives can include fatty acid methyl esters (FAMEs), which can help to improve degradability and reduce toxicity. Some fuel additives can include petroleum distillates, which can help with combustion. Some fuel additives can include mineral oils, which can serve various functions in the fuel. Some fuel additives can include elastomeric polymers, which can provide beneficial properties to the fuel.

In accordance with embodiments, a fuel additive composition is provided. The composition includes a hydrophilic absorbent that absorbs water, a lubricant that reduces friction, an octane adjuster that modifies the octane rating of fuel, an trialkyl benzene that decreases the emissions produced by fuel combustion, a dispersant that improves the dissolvability and dispersibility of a material, a polycyclic aromatic hydrocarbon that improves combustion performance, a fatty acid methyl ester used for degradability and less toxicity, petroleum distillates that help with combustion, a mineral oil derived from seal blubber, and an elastomeric polymer that provides beneficial properties to the fuel.

In accordance with other embodiments, a method of enhancing the properties of fuel is provided, such as increasing fuel efficiency and decreasing emissions. The method includes providing a fuel additive composition that includes the aforementioned components, and adding the fuel additive composition to the fuel. The hydrophilic absorbent absorbs water, the lubricant reduces friction, the octane adjuster modifies the octane rating of the fuel, the trialkyl benzene decreases the emissions produced by fuel combustion, the dispersant improves the dissolvability and dispersibility of the fuel, the polycyclic aromatic hydrocarbon improves combustion performance, the fatty acid methyl ester provides degradability and less toxicity, the petroleum distillates help with combustion, the mineral oil is derived from seal blubber, and the elastomeric polymer provides beneficial properties to the fuel.

Overall, the fuel additive has a synergistic outcome of improved fuel efficiency. When a vehicle operates without the fuel additive in regular fuel (e.g., gasoline or diesel), the fuel efficiency may be X distance (e.g., kilometers or miles) per volume of fuel consumed (e.g., liters or gallons). However, after using the fuel additive in the same fuel in the same vehicle, the fuel efficiency is Y, wherein Y is larger than X. As such, the vehicle has better fuel efficiency by being able to travel a further distance on the same volume of fuel. This difference is an important improvement in fuel efficiency, which can be obtained with the fuel additive described herein.

Additionally, another synergistic outcome is reduced emissions. When the vehicle operates without the fuel additive in regular fuel (e.g., gasoline or diesel), the emissions may be W amount (e.g., volume or weight). However, after using the fuel additive in the same fuel in the same vehicle, the emissions is V, wherein V is smaller than W. As such, the vehicle has better reduced emissions on the same volume of fuel. This difference is an important improvement in emissions and reduction of pollution, which can be obtained with the fuel additive described herein.

FIG. 1 illustrates, in a flowchart, operations for enhancing the properties of fuel with a specific additive composition in accordance with certain embodiments. Step 100 involves the provision of a fuel additive composition. This composition comprises a hydrophilic absorbent, a lubricant, an octane adjuster, an trialkyl benzene, a dispersant, a polycyclic aromatic hydrocarbon, a fatty acid methyl ester, petroleum distillates, a mineral oil, and an elastomeric polymer.

Step 102 entails the process of combining the fuel additive composition with the fuel. This step is executed to mix the additive with the fuel to ensure that the properties of the additive are distributed throughout the fuel. The process can involve direct pouring, injection, or mixing in a fuel tank or a fuel system. The action of Step 102 involves using equipment or methods to introduce the additive into the fuel. This could involve manual methods or automated dosing systems that measure and inject the additive into the fuel at various points such as a fuel depot, refinery, or vehicle's fuel system. The objective of Step 102 is to achieve a uniform distribution of the additive in the fuel, which allows for the performance of the fuel to be enhanced when utilized in an engine. The effectiveness of this step can be assessed by the uniformity of the mixture, the stability of the additive within the fuel, and the performance improvements in the engine, such as an adjusted octane rating, reduced emissions, improved lubricity, and enhanced combustion.

In summary, Step 102 is the final step where the fuel additive composition, with its components designed to absorb water, reduce friction, adjust octane rating, decrease emissions, improve dissolvability, enhance combustion performance, provide degradability, assist with combustion, derive benefits from mineral oil, and provide beneficial properties from the elastomeric polymer, is introduced into the fuel to achieve the enhancements specified in the composition. The fuel additive composition can provide the improvements in fuel economy.

In some embodiments, the properties of the improve fuel additive combine to improve the fuel economy. A vehicle that uses the fuel additive can decrease fuel consumption by increasing the miles per gallon (or liter). Accordingly, the fuel additive can be used to improve fuel economy of the vehicle by increasing miles per gallon (liter) of fuel.

Each component is quantified in terms of weight percentage in the composition to ensure that the product performs as intended when added to fuel. The concentrations and types of each component are selected based on their effects on the fuel's properties, performance, and emissions.

In some embodiments, a fuel additive includes a hydrophilic absorbent, lubricant, octane adjuster, trialkyl benzene, dispersant, polycyclic aromatic hydrocarbon (PAH), fatty acid methyl ester (FAME), petroleum distillates, mineral seal oil, and elastomeric polymer.

In some embodiments, the fuel additive can include a hydrophilic absorbent that absorbs water. The hydrophilic absorbent is tasked with managing water content in the fuel. Materials such as ethylene glycol and propylene glycol are used for their ability to associate with water molecules, thus preventing phase separation and maintaining combustion efficiency. These materials are included in the fuel additive in concentrations ranging from about 0.4 to about 0.7 wt %.

For example, ethylene glycol and other hydrophilic absorbent materials can be used in the fuel additive to associate with water molecules. This allows for the ethylene glycol in the fuel additive to associate with water molecules for improved processing during the combustion process. In some aspects, the hydrophilic absorbent can include an alkyl glycol. The alkyl glycol can include ethylene glycol, propylene glycol, diethylene glycol, triethylene glycol, tetraethylene glycol, polyethylene glycol, neopentyl glycol, butanediol (1,4-butanediol), and mixtures thereof. Accordingly, alkyl glycols can be used in the fuel as a hydrophilic absorbent material. However, the alkyl glycols could be included in the fuel additive for other purposes.

In some embodiments, the hydrophilic absorbent material is ethylene glycol or propylene glycol. An example includes ethylene glycol as the hydrophilic absorbent material.

The hydrophilic absorbent material can be present in the fuel additive in an amount of about 0.54 wt %, or about 0.5 to 0.6 wt %, or about 0.4 to about 0.7 wt %.

In some embodiments, the fuel additive can include a lubricant that facilitates providing the fuel additive with lubriciousness and flow with good surface tension properties. The lubricant component may serve to reduce friction within the engine's moving parts, thereby enhancing mechanical efficiency and extending the lifespan of the engine. Alkyl benzenes, such as ethylbenzene and propylbenzene, are used for their lubricious properties. They are present in the fuel additive in amounts of about 0.5 to about 0.85 wt %.

In some aspects, the lubricant can include an alkyl benzene. The alkyl benzenes can include methylbenzene (toluene), ethylbenzene, propylbenzene, butylbenzene, cumene, docylbenzene, nonylbenzene, diphenylmethane, octylbenzene, heptylbenzene, and combinations thereof. However, the alkyl benzene can be used in the fuel additive for other reasons.

In some embodiments, the lubricant can include ethylbenzene or propyl benzene.

The lubricant material can be present in the fuel additive in an amount of about 0.67 wt %, or about 0.6 to 0.75 wt %, or about 0.5 to about 0.85 wt %.

In some embodiments, the fuel additive can include an octane adjuster, which can be used to adjust the octane of the fuel. The octane adjuster influences the fuel's octane rating, which is a measure of the fuel's ability to resist knocking during combustion. Alkyl xylenes, including various dialkylbenzenes, are used to adjust the octane rating. By doing so, the fuel can be optimized for different engine types and performance requirements. The octane adjuster is present in the fuel additive in concentrations of about 4.5 to about 6.25 wt %.

The octant adjustment can be achieved with alkyl xylenes (e.g., two alkyl groups on phenyl ring), such as 1,2-dialkylbenzene, 1,3-dialkylbenzene, or 1,4-dialkylbenzene. Each alkyl group on the benzene can independently be methyl, ethyl, propyl, butyl, pentyl, hexyl, heptyl, octyl, nonyl, and the like. However, the xylenes can be used in the fuel additive for other reasons.

In some embodiments, the octane adjuster can be a combination of xylenes, which can be dimethyl xylenes.

The octane adjuster can be present in the fuel additive in an amount of about 5.11 wt %, or about 5 to about 5.5 wt %, about 4.75 to about 5.75 wt %, or about 4.5 to about 6.25 wt %.

In some embodiments, the fuel additive can include a trialkyl benzene, which may be useful to reduce the emissions of the fuel. The trialkyl benzene can include any type of alkyl group, which include three alkyl groups attached to the phenyl ring. The three alkyl groups can be attached to any carbon, but the 1,2,4 arrangement is preferred. Each alkyl group on the benzene can independently be methyl, ethyl, propyl, butyl, pentyl, hexyl, heptyl, octyl, nonyl, and the like. The trialkyl benzene decreases the harmful emissions produced during fuel combustion. Trialkyl benzenes, particularly 1,2,4-trimethylbenzene, are used to achieve this effect. The trialkyl benzene is present in the composition in a range of about 0.15 to about 0.5 wt %. However, the trialkyl benzene can be used in the fuel additive for other reasons.

In some embodiments, the trialkyl benzene can be 1,2,4-trimethylbenzene.

The trialkyl benzene cab be present in the fuel additive in an amount of about 0.31 wt %, or about 0.25 to about 0.35 wt %, about 0.2 to about 0.4 wt %, or about 0.15 to about 0.5 wt %.

In some embodiments, the fuel additive can include a dispersant, which can be used to improve the properties of the fuel additive. The dispersant can include an a branched alkyl alcohol. There can be one or more alkyl branches off a primary alkyl chain. One of the alkyl branches or the alkyl chain can include the hydroxy group to form the alcohol. Each alkyl group for an alkyl branch or alkyl trunk (e.g., primary chain) can independently be methyl, ethyl, propyl, butyl, pentyl, hexyl, heptyl, octyl, nonyl, and the like. However, the branched alkyl alcohol can be used in the fuel additive for other reasons.

In some embodiments, the dispersant can be 2-ethylhexanol.

The dispersant can be present in the fuel additive in an amount of about 6.27 wt %, or about 6.20 to about 6.50 wt %, about 6.0 to about 6.75 wt %, or about 5.8 to about 6.8 wt %.

In some embodiments, the fuel additive can include a polycyclic aromatic hydrocarbon (PAH). The PAH can have various functions in the fuel additive, such as combustion performance improvement. The PAH can be various types of PAHs, such as naphthalene anthracene, phenanthrene, fluoranthene, pyrene, benz[a]anthracene, chrysene, benzo[b]fluoranthene, benzo[k]fluoranthene, benzo[a]pyrene, benzo[ghi]perylene, coronene, and others. However, the PAH can be used in the fuel additive for other reasons.

In some embodiments, the PAH can be naphthalene.

The PAH can be present in the fuel additive in an amount of about 0.06 wt %, or about 0.04 to 0.08 wt %, about 0.2 to about 0.1 wt %, or about 0.15 to about 0.25 wt %.

In some embodiments, the fuel additive can include a fatty acid methyl ester (FAME), which can be used for degradability and less toxicity. The FAME can be any aliphatic FAME, which can include C10-C30 alkyl FAME, C12-C24 alkyl FAME, or C16-C18 alkyl FAME. The FAMEs can be used in the fuel additive for any reason.

In some embodiments, the FAME can be C16 FAME and/or C18 FAME.

The FAME can be present in the fuel additive in an amount from about 0.54 wt %, or about 0.5 to about 0.6 wt %, about 0.4 to about 0.7 wt %, or about 0.3 to about 0.8 wt %. In some aspects, the FAME can include C18 FAME at from about 0.42 wt %, or about 0.4 to about 0.5 wt %, about 0.35 to about 0.6 wt %, or about 0.3 to about 0.7 wt %. In some aspects, the FAME can include C16 FAME at from about 0.12 wt %, or about 0.1 to about 0.2 wt %, about 0.08 to about 0.25 wt %, or about 0.05 to about 0.35 wt %.

In some embodiments, the fuel additive can include petroleum distillates. The petroleum distillates, which can help with combustion. The petroleum distillates can include straight-chain and branched-chain alkanes, cycloalkanes, and aromatic hydrocarbons, are major components of gasoline. Petroleum distillates are a broad category of hydrocarbons derived from the distillation of crude oil. They include a wide range of compounds with varying boiling points, and their composition depends on the specific refining process. In the context of fuels, petroleum distillates are commonly used as components in various types of fuels, including gasoline and diesel.

The petroleum distillates can be present in the fuel additive at about 72.63 wt %, or about 20 to about 80 wt %, or about 45 to about 85 wt %, or about 50 to about 90 wt % (e.g., 20 to 90 wt %).

In some embodiments, the fuel additive can include a mineral oil. The mineral oil can include white mineral oil, technical grade mineral oil, heavy mineral oil, food mineral oil, pharmaceutical mineral oil, cosmetic mineral oil, industrial mineral oil, mineral seal oil, and the like.

In some embodiments, the mineral oil is mineral seal oil. The mineral seal oil can be derived from seal blubber, which can be mineral harp seal oil or mineral hooded seal oil, as well as processed mineral seal oil, and industrial mineral seal oil. Mineral Seal Oil (CAS 8012-95-1) is a low viscosity, highly refined, paraffinic mineral oil which is almost odorless, colorless and highly oxidation stable.

The mineral seal oil can be present in the fuel additive in an amount of about 12.55 wt %, or about 10 to about 20 wt %, about 8 to about 25 wt %, or about 5 to about 30 wt %.

In some embodiments, the fuel additive can include an elastomeric polymer, which can provide beneficial properties to the fuel when provided in the identified amounts. The elastomeric polymer can include polyisobutene (polyisobutylene), polybutene (polybutylene), polyisoprene, polybutadiene, styrene-butadiene rubber, butyl rubber, chloroprene rubber (neoprene), ethylene propylene diene monomer, and nitrile rubber.

In some embodiments, the elastomeric polymer is polyisobutene. The polyisobutene can be from about 800,000 to 2,600,000, or about 1,110,000 Da in molecular weight (e.g., Mv viscosity average). The polyisobutene may also include a talc separating agent, at about 8 wt %, or about 6-10 wt %. The polyisobutene may also include butylated hydroxytoluene at about 500 ppm, or about 400 to about 600 ppm.

The elastomeric polymer can be present in the fuel additive in an amount of about 1.32 wt %, or about 1.25 wt % to about 1.5 wt %, about 1.1 wt % to about 1.7 wt %, or about 1 wt % to about 2 wt %. In an alternative, the elastomeric polymer can be present from about 1 to about 60 wt %, about 1.25 to about 50 wt %, about 1.5 to about 40 wt %, about 1.75 to about 30 wt %, about 2 to about 25 wt %, about 2.25 to about 15 wt %, or about 2.5 to about 10 wt %. Ranges between 1-10 wt %, 1-8 wt %, 1-6 wt %, 1-5 wt %, 1-4 wt %, and 1-3 wt % can also be used for the elastomeric polymer.

In some embodiments, a fuel additive includes: ethylene glycol, ethylbenzene, xylenes, 1,2,4-trimethylbenzene, 2-ethylhexanol, naphthalene, 16 carbon fatty acid methyl ester, 18 carbon fatty acid methyl ester, petroleum distillates, mineral seal oil, and polyisobutene. The fuel additive can be used on diesel and regular unleaded gasoline.

In some embodiments, the fuel additive composition is configured for use in diesel.

In some embodiments, the fuel additive composition is configured for regular unleaded gasoline. For regular unleaded gasoline, the fuel additive can omit a FAME.

In some embodiments, a method of enhancing the properties of fuel can include: providing a fuel additive composition that includes a hydrophilic absorbent, a lubricant, an octane adjuster, an trialkyl benzene, a dispersant, a polycyclic aromatic hydrocarbon, a fatty acid methyl ester, petroleum distillates, a mineral oil, and an elastomeric polymer; and adding the fuel additive composition to the fuel. The components are as described herein.

In some embodiments, a method of treating a type of fuel can be performed. The method includes applying a mixture of chemical compounds as a fuel additive in accordance with an embodiment herein to a type of fuel.

In some embodiments, a method of improving fuel economy in a vehicle can include: providing the fuel additive of one of the embodiments; providing a vehicle having a fuel tank; introducing the fuel additive into fuel in the fuel tank of the vehicle; operating the vehicle by combusting the fuel in an engine, wherein fuel economy is improved with fuel having the fuel additive compared to the fuel without the fuel additive. In some aspects, the improvement in fuel economy is at least 4%, or optionally about 4% to about 50%, or about 10% to about 25%, or about 11% to about 20%, or about 12% to about 15%. The engine can be an internal combustion engine or a diesel engine. The method can include introducing 1 oz of fuel additive to 10 gallons of fuel, or about 0.5 to about 2 ounces of fuel additive to about 10 gallons of fuel, or about 0.75 to about 1.5, or about 0.8 to about 1.25 ounces of fuel additive per 10 gallons of fuel. This amount of additive can be based on a dilute polyisobutene content of about 1-10%. However, the amount of polyisobutene can be increased to at least 30, 40, 50, or 60 wt % with solvation. These "thicker" solutions can be used in lesser amounts than the "thinner" solutions with less polyisobutene. When thicker, the amount of fuel additive can be less than 1 ounce per 10 gallons, less than 0.75 ounce per 10 gallons, less than 0.5 ounce per 10 gallons, or less than 0.25 ounce per 10 gallons. Thus, the thickness of the fuel additive can be varied so that the amount of fuel additive used in the vehicle can be varied.

In some embodiments, a method of reducing emissions in a vehicle can include: providing the fuel additive of one of the embodiments; providing a vehicle having a fuel tank; introducing the fuel additive into fuel in the fuel tank of the vehicle; operating the vehicle by combusting the fuel in an engine, wherein emissions from the vehicle are reduced with fuel having the fuel additive compared to the fuel without the fuel additive. In some aspects, the improvement in emissions is: hydrocarbons reduced by up to about 78%; NOx reduced by up to about 5%; NO reduced by up to about 5%; NO2 reduced by up to about 3%; CO reduced by up to about 3%; and CO2 reduced by up to about 3%. The method can include introducing 1 oz of fuel additive to 10 gallons of fuel, or about 0.5 to about 2 ounces of fuel additive to about 10 gallons of fuel, or about 0.75 to about 1.5, or about 0.8 to about 1.25 ounces of fuel additive per 10 gallons of fuel. However, the amount of polyisobutene can be increased to at least 30, 40, 50, or 60 wt % with solvation. These "thicker" solutions can be used in lesser amounts than the "thinner" solutions with less polyisobutene. When thicker, the amount of fuel additive can be less than 1 ounce per 10 gallons, less than 0.75 ounce per 10 gallons, less than 0.5 ounce per 10 gallons, or less than 0.25 ounce per 10 gallons. Thus, the thickness of the fuel additive can be varied so that the amount of fuel additive used in the vehicle can be varied.

EXAMPLES

The fuel additive with the following composition was provided: ethyl glycol at 0.54 wt %; ethylbenzene at 0.67 wt %; xylenes at 5.11 wt %; 1,2,4-trimethylbenzene at 0.31 wt %; 2-ethylhexanol at 6.27 wt %; naphthalene at 0.06 wt %; C16 FAME at 0.12 wt %; C18 FAME at 0.42 wt %; petroleum distillates at 72.63 wt %; mineral seal oil at 12.55 wt %; and polyisobutene at 1.32 wt %. The fuel additive was tested in various vehicles using diesel and gasoline. The results show that the fuel additive increased fuel efficiency by increasing the miles per gallon (miles per liter). Table 1 shows the results of fuel economy and location, along with the percent increased fuel economy.

TABLE 1

Fuel Economy

| Vehicle | MPG Without Fuel Additive | MPG With Fuel Additive | Location | Fuel Efficiency Increase % |
|---|---|---|---|---|
| 2020 F-350 Powerstroke 6.7 Diesel | 18.9 | 25.6 | Utah | 35.45% |
| 2017 Chevy Colorado | 29.9 | 39 | California | 30.43% |
| School Bus | 6.7 | 8.1 | Utah | 20.9% |
| 2008 GMC Sierra 2500 Duramax | 14.5 | 18.6 | Utah | 25.28% |
| 2015 VW Passat 2.0 L TDI diesel | 36.2 | 43 | Utah | 18.78% |

TABLE 1-continued

| Fuel Economy | | | | |
|---|---|---|---|---|
| Vehicle | MPG Without Fuel Additive | MPG With Fuel Additive | Location | Fuel Efficiency Increase % |
| 2017 GMC Acadia (gas) | 24 | 29 | Utah | 20.83% |
| 2004 Chevy Colorado (Gas) | 14 | 20 | Utah | 42.86% |
| 2010 Ford F150 (Gas) | 20 | 25 | Utah | 25% |
| 2012 Audi A3 wagon TDI Diesel | 44 | 55 | Utah | 25% |
| 2014 Audi A3 TDI Diesel | 44 | 53 | Utah | 20.45% |
| 2017 Ford F350 6.2 L (gas) | 8.12 | 9.09 | Utah | 11.95% |
| Range rover 3.0 L Diesel | 21 | 24 | Utah | 14.29% |
| Freightliner Detroit 15 L (4 different trucks) | | | | |
| Truck 1 | 4.46 | 5.53 | Utah | 19.18% |
| Truck 2 | 4346 | 5.27 | Utah | 13.58% |
| Truck 3 | 5.66 | 5.39 | Utah | 4.77% |
| Truck 4 | 5.66 | 5.91 | Utah | 4.42% |

The exhaust was analyzed with and without use of the fuel additive. The vehicle tested was a 2004 Ford Powerstroke 6.0 L. The fuel additive reduced the emissions as follows from the exhaust gas: hydrocarbons reduced by 78%: $NO_x$ reduced by 5%: NO reduced by 5%; $NO_2$ reduced by 3%; CO reduced by 3%; and $CO_2$ reduced by 3%. Thus, the fuel additive can be used to reduce emissions from a vehicle.

In some aspects, the improvement in emissions is: hydrocarbons reduced by up to about 78%, or about 10% to about 80%, or about 25% to about 75%; or about 40% to 50%; $NO_x$ reduced by up to about 5%, or about 1% to about 8%, about 2.5% to about 6%, or about 3% to about 7%; NO reduced by up to about 5% %, or about 1% to about 8%, about 2.5% to about 6%, or about 3% to about 7%; $NO_2$ reduced by up to about 3%, or about 1% to about 5%, or about 2% to 4%; CO reduced by up to about 3%; and $CO_2$ reduced by up to about 3%, or about 1% to about 5%, or about 2% to 4%.

Definitions

In addition, the aforementioned functional groups may, if a particular group permits, be further substituted with one or more additional functional groups or with one or more hydrocarbyl moieties such as those specifically enumerated above. Analogously, the above-mentioned hydrocarbyl moieties may be further substituted with one or more functional groups or additional hydrocarbyl moieties such as those specifically enumerated.

The term "alkyl" or "aliphatic" as used herein refers to a branched or unbranched saturated hydrocarbon group typically although not necessarily containing 1 to about 24 carbon atoms, such as methyl, ethyl, n-propyl, isopropyl, n-butyl, isobutyl, t-butyl, octyl, decyl, and the like, as well as cycloalkyl groups such as cyclopentyl, cyclohexyl, and the like. Generally, although again not necessarily, alkyl groups herein contain 1 to about 18 carbon atoms, or 1 to about 12 carbon atoms. The term "lower alkyl" intends an alkyl group of 1 to 6 carbon atoms. Substituents identified as "$C_1$-$C_6$ alkyl" or "lower alkyl" contains 1 to 3 carbon atoms, and such substituents contain 1 or 2 carbon atoms (i.e., methyl and ethyl). "Substituted alkyl" refers to alkyl substituted with one or more substituent groups, and the terms "heteroatom-containing alkyl" and "heteroalkyl" refer to alkyl in which at least one carbon atom is replaced with a heteroatom, as described in further detail infra. If not otherwise indicated, the terms "alkyl" and "lower alkyl" include linear, branched, cyclic, unsubstituted, substituted, and/or heteroatom-containing alkyl or lower alkyl, respectively.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

All references recited herein are incorporated herein by specific reference in their entirety.

The invention claimed is:

1. A fuel additive composition, consisting of:

a hydrophilic absorbent component is present at about 0.4 to about 0.7 wt %;

a lubricant is present at about 0.5 to about 0.85 wt %;

an octane adjuster is present at about 4.5 to about 6.25 wt %;

an emissions reducer is present at about 0.15 to about 0.5 wt %;

a dispersant is present at about 5.8 to about 6.8 wt %;

a polycyclic aromatic hydrocarbon is present at about 0.04 to about 0.08 wt %;

at least one fatty acid methyl ester is present at about 0.3 to about 0.8 wt %;

a petroleum distillate is present at about 20 to about 90 wt %;

a mineral oil is present at about 5 to about 30 wt %; and a elastomeric polymer is present at about 1 to about 60 wt %.

2. The fuel additive composition of claim 1, wherein:

the hydrophilic absorbent component is ethylene glycol;

the lubricant is ethylbenzene;

the octane adjuster includes xylenes;

the emissions reducer includes 1,2,4,-trimethylbenzene;

the dispersant includes 2-ethylhexanol;

the polycyclic aromatic hydrocarbon includes naphthalene;

the least one fatty acid methyl ester includes a C16 alkyl chain fatty acid methyl ester and a C18 alkyl chain fatty acid methyl ester;

the petroleum distillate;

the mineral oil is mineral seal oil; and the elastomeric polymer is polyisobutene, the fuel additive composition consisting of:

the ethylene glycol component is present at about 0.4 to about 0.7 wt %;

the ethylbenzene is present at about 0.5 to about 0.85 wt %;

the xylenes are present at about 4.5 to about 6.25 wt %;

the 1,2,4,-trimethylbenzene is present at about 0.15 to about 0.5 wt %;

the 2-ethylhexanol is present at about 5.8 to about 6.8 wt %;

the naphthalene is present at about 0.04 to about 0.08 wt %;

C16 alkyl chain fatty acid methyl ester and a C18 alkyl chain fatty acid methyl ester are present at about 0.3 to about 0.8 wt %;

the petroleum distillate is present at about 50 to about 90 wt %;

the mineral seal oil is present at about 5 to about 30 wt %; and the polyisobutene is present at about 1 to about 10 wt %.

3. The fuel additive composition of claim 2, the fuel additive composition consisting of:

the ethylene glycol component is present at about 0.54 wt %;

the ethylbenzene is present at about 0.67 wt %;

the xylenes are present at about 5.11 wt %;

the 1,2,4,-trimethylbenzene is present at about 0.31 wt %;

the 2-ethylhexanol is present at about 6.27 wt %;

the naphthalene is present at about 0.06 wt %;

C16 alkyl chain fatty acid methyl ester and a C18 alkyl chain fatty acid methyl ester are present at about 0.54 wt %;

the petroleum distillate is present at about 72.63 wt %;

the mineral seal oil is present at about 12.55 wt %; and the polyisobutene is present at about 1.32 wt %.

4. A method of treating fuel, comprising:
providing the fuel additive of claim 1;
providing a fuel for an engine; and
introducing the fuel additive to the fuel.

5. The method of claim 4, wherein the engine is an internal combustion engine or a diesel engine.

6. The method of claim 5, further comprising introducing 1 oz of fuel additive to 10 gallons of fuel.

7. A method of improving fuel economy in a vehicle, comprising
providing the fuel additive of claim 1;
providing a vehicle having a fuel tank;
introducing the fuel additive into fuel in the fuel tank of the vehicle;
operating the vehicle by combusting the fuel in an engine, wherein fuel economy is improved with fuel having the fuel additive compared to the fuel without the fuel additive.

8. The method of claim 7, wherein the improvement in fuel economy is at least 4%.

9. The method of claim 8, further comprising introducing about 0.5 to about 2 ounces of fuel additive to about 10 gallons of fuel.

10. A method of reducing emissions in a vehicle, comprising
providing the fuel additive of claim 1, wherein the fuel additive comprises the hydrophilic absorbent component that absorbs water;
providing a vehicle having a fuel tank;
introducing the fuel additive into fuel in the fuel tank of the vehicle;
operating the vehicle by combusting the fuel in an engine, wherein emissions from the vehicle are reduced with fuel having the fuel additive compared to the fuel without the fuel additive.

11. The method of claim 7, wherein the improvement in emissions is: hydrocarbons reduced by up to about 78%; NOx reduced by up to about 5%; NO reduced by up to about 5%; $NO_2$ reduced by up to about 3%; CO reduced by up to about 3%; and $CO_2$ reduced by up to about 3%.

12. The method of claim 11, further comprising introducing 1 oz of fuel additive to 10 gallons of fuel.

13. A method of treating fuel, comprising:
providing the fuel additive of claim 2;
providing a fuel for an engine; and
introducing the fuel additive to the fuel.

14. A method of treating fuel, comprising:
providing the fuel additive of claim 3;
providing a fuel for an engine; and
introducing the fuel additive to the fuel.

15. A method of improving fuel economy in a vehicle, comprising
providing the fuel additive of claim 2;
providing a vehicle having a fuel tank;
introducing the fuel additive into fuel in the fuel tank of the vehicle;
operating the vehicle by combusting the fuel in an engine, wherein fuel economy is improved with fuel having the fuel additive compared to the fuel without the fuel additive.

16. A method of improving fuel economy in a vehicle, comprising
providing the fuel additive of claim 3;
providing a vehicle having a fuel tank;
introducing the fuel additive into fuel in the fuel tank of the vehicle;
operating the vehicle by combusting the fuel in an engine, wherein fuel economy is improved with fuel having the fuel additive compared to the fuel without the fuel additive.

17. A method of reducing emissions in a vehicle, comprising
providing the fuel additive of claim 2, wherein the fuel additive comprises the hydrophilic absorbent component that absorbs water;
providing a vehicle having a fuel tank;
introducing the fuel additive into fuel in the fuel tank of the vehicle;
operating the vehicle by combusting the fuel in an engine, wherein emissions from the vehicle are reduced with fuel having the fuel additive compared to the fuel without the fuel additive.

18. A method of reducing emissions in a vehicle, comprising
providing the fuel additive of claim 3, wherein the fuel additive comprises the hydrophilic absorbent component that absorbs water;
providing a vehicle having a fuel tank;
introducing the fuel additive into fuel in the fuel tank of the vehicle;
operating the vehicle by combusting the fuel in an engine, wherein emissions from the vehicle are reduced with fuel having the fuel additive compared to the fuel without the fuel additive.

19. A fuel additive comprising:
ethylene glycol present at about 0.54 wt %;
ethylbenzene present at about 0.67 wt %;
one or more xylenes present at about 5.11 wt %;
1,2,4,-trimethylbenzene present at about 0.31 wt %;
2-ethylhexanol present at about 6.27 wt %;
naphthalene present at about 0.06 wt %;
a C16 alkyl chain fatty acid methyl ester and a C18 alkyl chain fatty acid methyl ester present at about 0.54 wt %;
a petroleum distillate present at about 72.63 wt %;
a mineral seal oil present at about 12.55 wt %; and
a polyisobutene present at about 1.32 wt %.

20. A fuel additive comprising:
ethylene glycol present at about 0.4 to about 0.7 wt %;
ethylbenzene present at about 0.5 to about 0.85 wt %;
one or more xylenes present at about 4.5 to about 6.25 wt %;
1,2,4,-trimethylbenzene present at about 0.15 to about 0.5 wt %;
2-ethylhexanol present at about 5.8 to about 6.8 wt %;
naphthalene present at about 0.04 to about 0.08 wt %;
a C16 alkyl chain fatty acid methyl ester and a C18 alkyl chain fatty acid methyl ester present at about 0.3 to about 0.8 wt %;
a petroleum distillate present at about 50 to about 90 wt %;
a mineral seal oil present at about 5 to about 30 wt %; and
polyisobutene present at about 1 to about 10 wt %.

* * * * *